United States Patent [19]

de Vos et al.

[11] Patent Number: 4,642,742

[45] Date of Patent: Feb. 10, 1987

[54] LUMINAIRE WITH PIVOTAL COVER MEMBER HAVING COMPRESSIBLE GASKET

[75] Inventors: Hendrik A. J. de Vos; Elzear R. Labouliere, both of Swansea, Mass.

[73] Assignee: GTE Products Corporation, Danvers, Mass.

[21] Appl. No.: 719,946

[22] Filed: Apr. 4, 1985

[51] Int. Cl.[4] ..... F21V 17/00

[52] U.S. Cl. ..... 362/375; 362/269; 362/307

[58] Field of Search ..... 362/375, 370, 190, 191, 362/200, 261, 267, 296, 341, 427, 280, 282, 322, 323, 255, 263, 269, 307, 329, 388, 430, 455

[56] References Cited

U.S. PATENT DOCUMENTS

| | | | |
|---|---|---|---|
| 3,328,579 | 6/1967 | Green | 362/375 |
| 4,001,572 | 1/1977 | Stein | 362/296 |
| 4,379,321 | 4/1983 | Plemmons et al. | 362/370 |
| 4,488,205 | 12/1984 | Quiogue | 362/296 |
| 4,538,217 | 8/1985 | Ewing et al. | 362/375 |

*Primary Examiner*—Willis R. Wolfe, Jr.
*Attorney, Agent, or Firm*—Lawrence R. Fraley

[57] ABSTRACT

A luminaire especially adapted for outdoor use wherein the cover member is pivotally connected to the housing to permit ready access to the luminaire's internal parts (e.g., lamp and ballast components). Located within the cover is a lens which is held in position by a compressible gasket. The gasket is compressed against an internally located mounting plate to provide a seal as well as assist in retaining the lens in position. The preferred light source is a high intensity discharge (HID) lamp (e.g., high pressure sodium).

12 Claims, 7 Drawing Figures

LUMINAIRE WITH PIVOTAL COVER MEMBER HAVING COMPRESSIBLE GASKET

DESCRIPTION

The invention relates to luminaires and particularly to luminaires which utilize a high intensity discharge (HID) lamp (e.g., high pressure sodium) therein.

As will be defined below, the luminaire of the instant invention is able to provide both ready access to the interior thereof as well as means for assuring an effective seal between the luminaire's lens and cover members. The invention is thus ideally suited for use in an outdoor environment. As is known, such access has often proven extremely difficult in many prior art luminaires.

It is thus believed that a luminaire providing such access without a corresponding compromise to the seals necessary to the luminaire to enable effective operation thereof in an adverse (e.g., outdoor) environment would constitute an advancement in the art.

DISCLOSURE OF THE INVENTION

It is a primary object of this invention to enhance the art of luminaires and particularly luminaires of the outdoor variety.

These and other objects are accomplished by the instant invention wherein there is provided a luminaire comprising a housing defining an opening therein, a component mounting plate secured to the housing and including an aperture therein, a reflector positioned on the component mounting plate adjacent the aperture, a lamp extending within the reflector, and a cover member pivotally located on the housing for providing a cover for the opening upon closure thereof. The cover includes a lens therein and a compressible gasket located substantially about the lens, the closure of said cover causing compression of the gasket against the mounting plate substantially about the aperture. This compression in turn provides a seal about the lens and also assists in retaining the lens in position within the cover.

BEST MODE FOR CARRYING OUT THE INVENTON

For a better understanding of the present invention, together with other and further objects, advantages and capabilities thereof, reference is made to the following disclosure and appended claims in connection with the above-described drawings.

Figure 1:
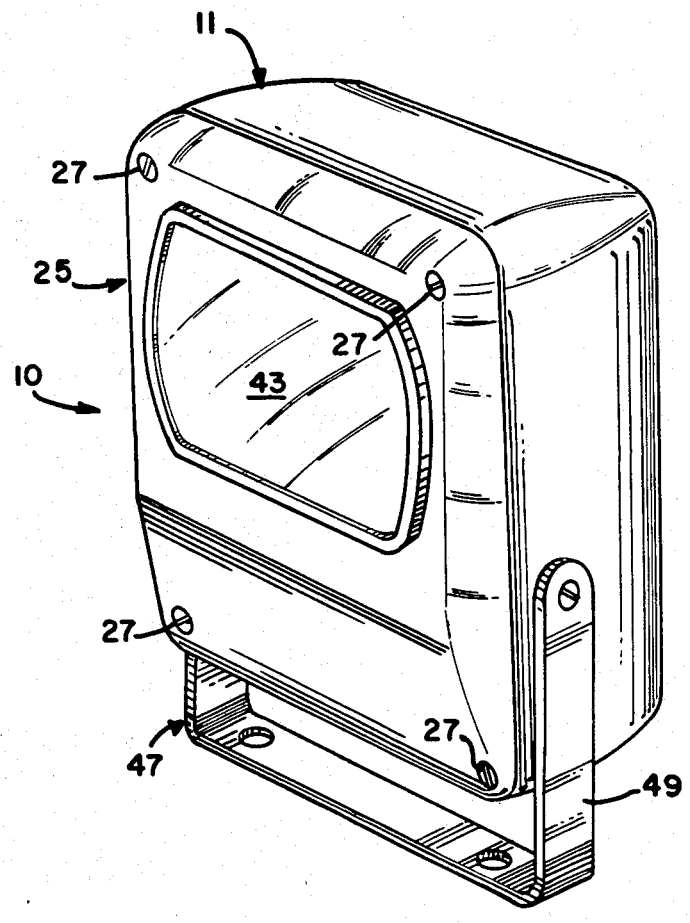
FIG. 1 is a front perspective view of a luminaire in accordance with a preferred embodiment of the invention.
Figure 2:
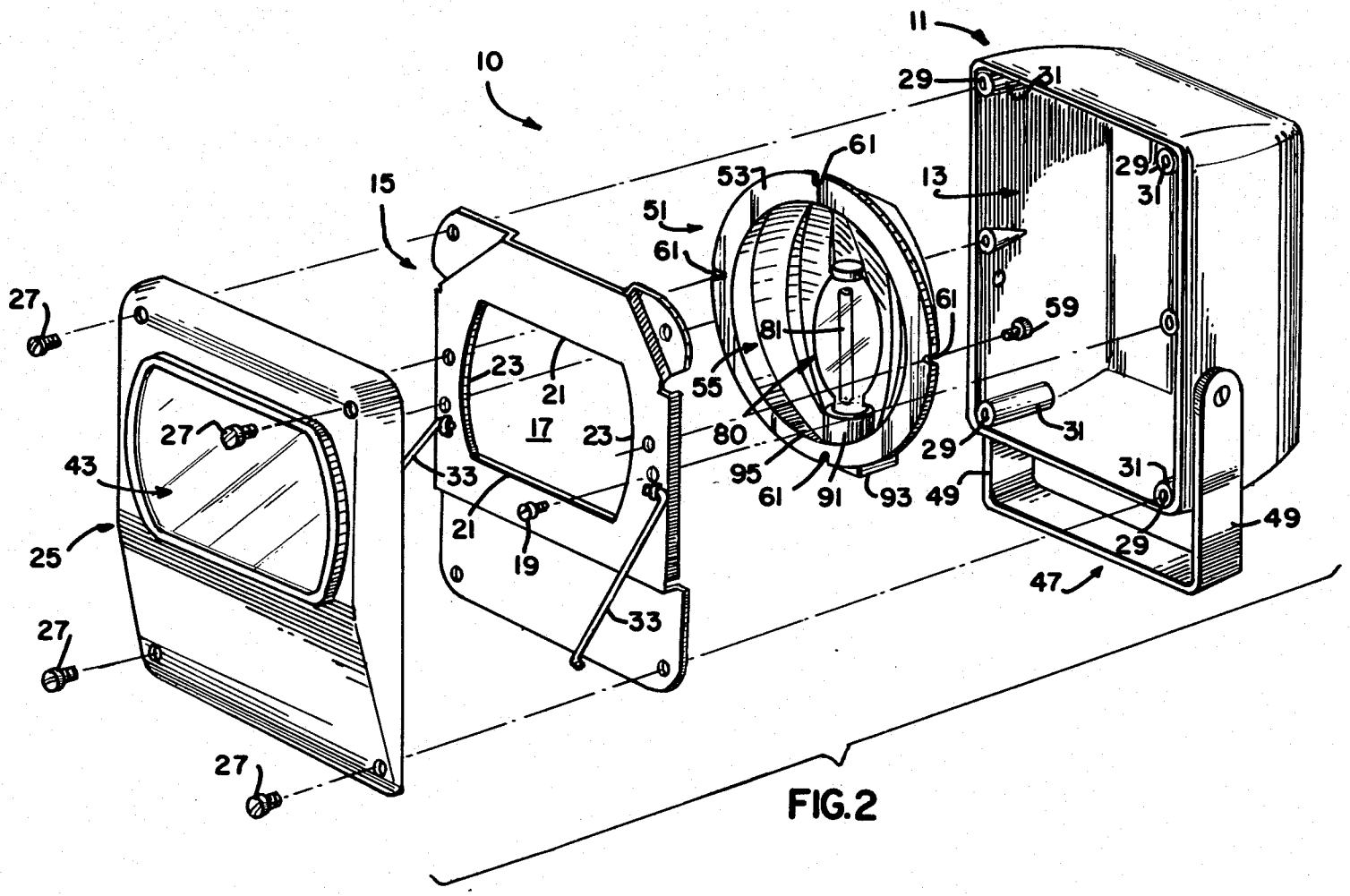
FIG. 2 is an exploded, front perspective view of the luminaire of FIG. 1.

With particular attention to FIGS. 1 and 2, there is shown a luminaire 10 in accordance with a preferred embodiment of the invention. Luminaire 10, as will be defined below, is capable of providing light output distributions (patterns) in at least two different orientations relative to and distant from the luminaire. As will also be understood from the following, these orientations are attainable without adjusting the position of the luminaire's housing.

Luminaire 10 includes a boxlike housing 11 which is preferably of metallic material (e.g., cast aluminum) which in turn defines a substantially planar, rectangular opening 13 along one end (or side) thereof. In one example, housing 11 possessed a width of about 10.00 inches, a length of about 11.875 inches and a depth of about 4.25 inches, thus illustrating the overall compact design of the instant invention.

Secured to housing 11 is a component mounting plate 15 which, as shown in FIG. 2, is of substantially planar configuration. Plate 15 includes an aperture 17 therein and is secured to housing 11 using only two retention screws 19 (only one shown in FIG. 2). When secured to housing 11, it is thus seen that plate 15 is located substantially across the planar opening 13. Aperture 17 is defined by two pairs of opposed sides so as to be of substantially rectangular configuration. Specifically, the first pair of opposed, longitudinal sides are of substantially straight configuration and represented by the numerals 21 in FIG. 2. In comparison, the opposed sides of the second pair are shorter in length and slightly curved, and represented by the numerals 23 in FIG. 2. Such a configuration for aperture 17 is preferred in the instant invention, particularly when utilizing a lens of substantially rectangular configuration. It is, of course, understood that other shapes (e.g., round) are readily possible for aperture 17. Component mounting tray 15 is also preferably metallic and, in one example, was formed from 20 ga. steel. One particularly noteworthy feature of the invention is that because the planar mounting tray 15 is secured to the boxlike housing 11 using only two retention screws, removal thereof is greatly facilitated such that access to the various electrical (e.g., ballast) components located behind the tray is possible. These components are not shown in FIG. 2 for illustration purposes, but are clearly illustrated in FIG. 4.

Figure 5:
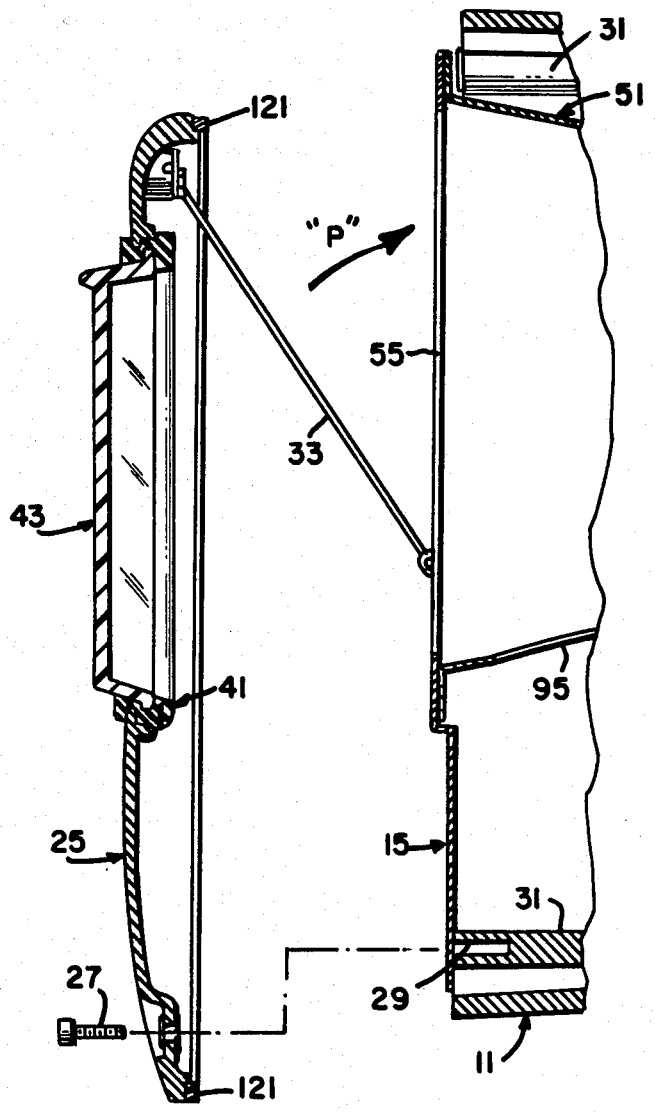
FIG. 5 is a partial, side elevational view, in section, of the luminaire of FIG. 1, illustrating the pivotal cover member and the lens located therein.

Luminaire 10 further includes a cover member 25 which is fixedly secured to housing 11 so as to provide a cover for opening 13. This securement is achieved utilizing only four retention screws 27. As illustrated in FIG. 2, the mounting plate 15 includes four holes, each located within one corner thereof, so as to enable passage of one of the retention screws 27 therethrough prior to positioning of said screw within a respective threaded opening 29 located within housing 11. Each threaded opening 29 is in turn located within a substantially cylindrical boss portion 31, each of which is part of and located substantially within a respective corner of housing 11. Attention is also directed to FIG. 5 for yet another view of this means of securement. In one example of the invention, cover member 25 was formed of cast aluminum and possessed a width of about 10.00 inches, a length of 11.875 inches and a depth of only about 0.75 inch. As shown in FIG. 5, and partly in FIG. 2, cover member 25 is pivotally located on housing 11 such that removal of the aforementioned four retention screws 27 (e.g., for purposes of repair and/or lamp replacement) results in the cover member 25 simply pivoting away from the housing's rectangular opening 13. This pivoting relationship is attained thrugh the use of two pivot arms 33 which are each pivotally secured at one end to the outer surface of the planar mounting plate 15 and at the other end thereof to the upper portion of cover member 25. In one embodiment of the invention, the ends of each pivot arm which engage the cover member 25 were interconnected by a common arm, thus resulting in a singular component of substantially U-shaped configuration. In such an arrangement, a pair of brackets or the like were utilized to secure the common arm to cover member 25, thereby enabling pivoting action of each of the projecting arms 33. This arrangement thus provides for ready access to the lamp utilized in luminaire 10 (e.g., for purposes of replacement) while still providing some means of maintaining connection between the housing and cover members. The defined pivotal motion "P" is best illustrated in FIG. 5.

Cover member 25 further includes an opening therein within which is located a compressible gasket 41 (FIG. 5) and a lens 43. Lens 43 may be either glass or plastic, and in one example was comprised of borosilicate glass. As illustrated in FIGS. 1 and 2, lens 43 is preferably of substantially rectangular configuration, as of course is the surrounding gasket 41. It is also within the scope of the invention to provide a lens of substantially round configuration and the invention is thus not limited to the rectangular configuration depicted herein. As will be defined below, gasket 41 is specifically designed such that the lens 43 fits only loosely therein when cover member 25 is in the open position. By the term "loosely positioned" is meant that the lens 43 may be easily removed (e.g., for purposes of replacement) and yet wherein the lens will not fall out without such manual removal. This is considered an important feature of luminaire 10 as will be further described below. In one example of the invention, a rectangular lens having a height of about 5.50 inches and a width of about 8.00 inches was utilized. In an alternative embodiment, a round lens having an outer diameter of about 7.00 inches was utilized. One example of a material for gasket 41 is silicone.

Luminaire 10 is preferably secured to a respective surface (e.g., vertical wall) through the use of either a U-shaped trunnion 47 (as shown) or, alternatively, by a swivel mount member (not shown) which, understandably, is preferably utilized to position the luminaire on a support pole or the like. As shown in FIGS. 1 and 2, the U-shaped trunnion includes a pair of upstanding arms 49 which are each connected to opposite sides of housing 11 so as to enable movement of the housing relative to these two pivot locations. When the aforementioned swivel mount member is utilized, this member is preferably secured to a bottom wall of the housing utilizing a singular retention nut. In both arrangements, it is thus possible to move the housing relative to the means of securement to thereby provide a variety of orientations for the luminaire.

Figure 4:
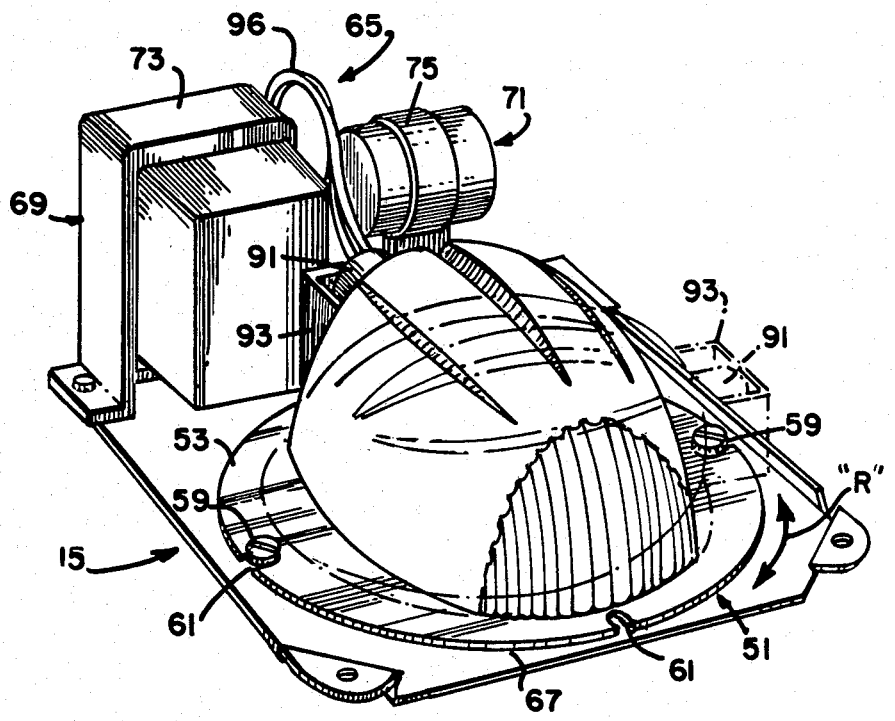
FIG. 4 is a perspective view of the reflector, mounting plate and ballast components in accordance with one embodiment of the invention.

As particularly illustrated in FIGS. 2 and 4, luminaire 10 is shown as further comprising a reflector 51 which is adapted for being securedly positioned in at least two different orientations on mounting plate 15 relative to aperture 17 therein. Specifically, reflector 51 includes an annular, planar flange portion 53 for being located on plate 15 in a flush relationship in such a manner that the luminaire operator may easily rotate reflector 51 (as indicated by the directional arrow "R" in FIG. 4). In both positions, the reflector's forward annular opening 55 (see also FIG. 5) is aligned with aperture 17. Accordingly, light reflected from the several different reflecting surfaces within reflector 51 is directed through aperture 17 and thereafter through the lens 43 located within cover member 25. When secured to plate 15, it is thus seen in FIG. 2 that the reflector (and the contained lamp) is positioned substantially within the chamber defined by the open-ended housing 11.

The flange portin 53 of reflector 51 is secured to mounting plate 15 by only a pair of retention screws 59 located on opposite sides of mounting plate 15 from the substantially rectangular aperture 17. Slots 61 (a total of four) are provided at approximately ninety degree intervals about the annular flange to accommodate screws 59. It is thus understood that only two slots 61 are utilized simultaneously, although it is of course possible to provide four retention screws for this purpose. However, use of only two screws has proven satisfactory for providing the necessary secured positioning of the reflector and the internally contained lamp. Removal of screws 59 such that reflector 51 can be rotated to a second position is accomplished simply by initially removing the four retention screws 27 which provide securement of front cover 25 to housing 11. The front cover is thereafter pivoted away from housing 11, and mounting plate 15 is then removed by simply removing the two retention screws 19. Ready access to reflector 51 to thereby enable repositioning thereof is thus provided in the instant invention.

As further shown in FIG. 4, the lamp ballast components 65 of the invention are also secured to the inner (or back) surface 67 of mounting plate 15. These components include a ballast 69 and starter (lamp igniter) 71. Securement is accomplished by corresponding brackets (e.g., 73 and 75) respectively. It is thus seen that these cmponents are also located within the housing's chamber when mounting plate 15 is secured thereto. These components are not illustrated in FIGS. 2 and 5 for clarification purposes.

Figure 3:
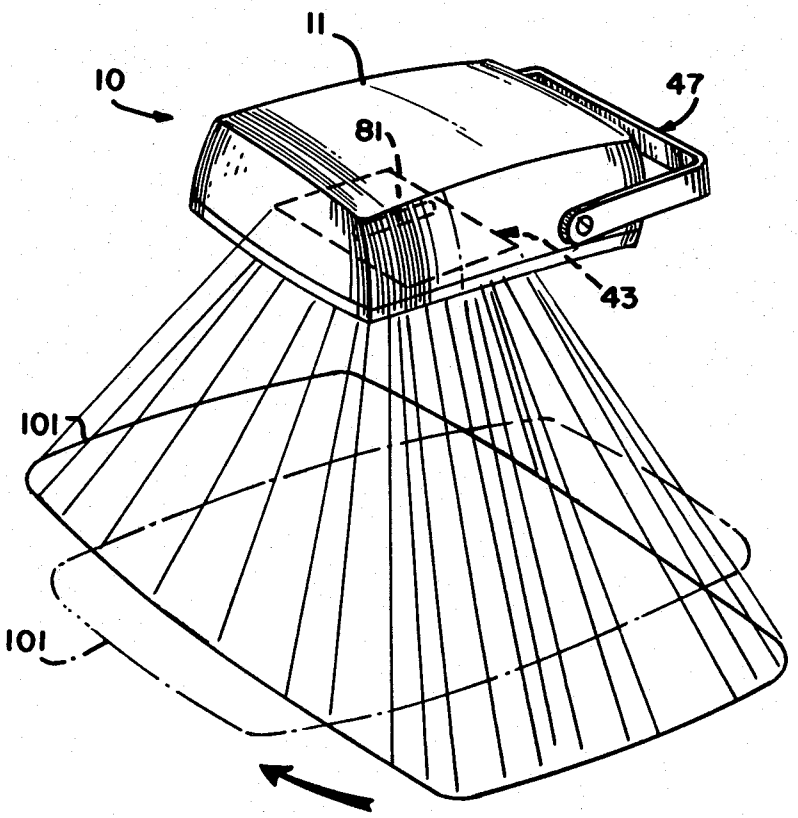
FIG. 3 is a perspective view of the invention illustrating the two different orientations for the light output distributions (patterns) provided by the invention.

The preferred light source is a high intensity discharge (HID) lamp 80 (FIGS. 2, 3). HID lamps are those having a gaseous discharge arc tube 81 and operate at pressures and current densities sufficient to generate the desired amount of visible radiation within the respective arcs. Such lamps have become very popular in the lighting field, and especially outdoor lighting, because of their high efficacy (more lumens per watt of consumed power), long operating life and sound lumen maintenance, and compactness of design. HID lamps generally fall within one of three categories: mercury lamps (typically containing a small quantity of mercury and a suitable starting gas such as argon within their arc tube), metal halide lamps (including mercury and argon, as above, in addition to a mixture of metallic iodide additives such as sodium, thallium, or indium), and high pressure sodium lamps (containing mercury and sodium, in addition to xenon which is ionized by a short high voltage pulse). Of these, the most preferred for use herein is a high pressure sodium lamp and even more particularly, one designed to be extremely energy efficient. Specifically, the high pressure sodium lamps preferably used in the invention produce 50, 70, 100 or 150 watts and operate at voltage levels of 120, 208, 240, and 277 volts. In one specific example, lamp 80 produced 70 watts while operating at normal line voltage (120 volts).

The ballast member 69, needed as a current limiter to prevent self-destruction because of the negative resistance characteristic (as the current therethrough increases, the lamp's resistance decreases) of HID lamps, is rated at 120 volts, 60 Hz, and 1.6 Amps, and can be purchased from the Advance Transformer Company, Chicago, Ill. The preferred starter (igniter) 71 needed to provide the aforedefined short, high voltage pulse, is also available from the Advance Transformer Company.

Lamp 80, as shown, is positioned substantially within reflector 51. This is accomplished, in accordance with the teachings of the invention, by providing a socket 91 which in turn is positioned on an external bracket 93 secured to an external surface of reflector 51. The wiring 96 to socket 91 is shown in FIG. 4 and is of sufficient length to enable the aforementioned rotational movement of the reflector. Socket 91, preferably of porcelain, passes through an opening 95 located within the reflector's wall adjacent bracket 93. Opening 95 is also shown in FIG. 5, the lamp, socket and bracket members not being shown for purposes of clarification. This arrangement thus enables simultaneous rotation of the socket and lamp components during the described rotational repositioning of reflector 51. The elongated arc length 81 of lamp 80 can thus be positioned either in the vertical orientation as depicted in FIG. 2 or, alternatively, in a substantially horizontal position when the reflector occupies the position represented by the dashed lines in FIG. 4. Socket 91 and bracket 93 are illustrated to the right (and by the dashed lines) in FIG. 4 when this second position is attained. Again, the respective wiring 96 is of sufficient length so as to assure connection to the socket at this latter orientation. Because socket 91 is positioned on bracket 93, which, as stated, is secured (e.g., soldered) to the illustrated outer surface of reflector 51, the socket is defined herein as being secured to the reflector. This definition is thus also meant to include other possible arrangements, including a positioning of the socket within the reflector and passing the respective wiring through a smaller aperture within the reflector's wall.

With particular attention to FIG. 3, there are shown the two orientations for the light output distributions (patterns) provided by the instant invention. Specifically, the light pattern 101 shown in solid is of substantially rectangular configuration and provided when the elongated arc length 81 of lamp 80 is oriented as shown in FIG. 2 (substantially vertical). The corresponding orientation of the rectangular lens 43 is also shown (hidden). Rotating the reflector and lamp components approximately ninety degrees in the manner defined above results in a similar rotation of the light pattern. In addition, this pattern, now shown by the dashed lines in FIG. 3, is slightly modified in that the narrower end portions thereof are somewhat foreshortened. This is caused by the corresponding shape of aperture 17 within mounting plate 15 and the respective straight sides of lens 43. It is possible, of course, to eliminate this foreshortening, if desired, by a corresponding increase in size for the mounting plate's aperture and adjacent lens member. In one example, as stated, a round aperture and similarly shaped lens was utilized. The aforementioned cutoff is not considered serious, however, for most applications of the instant invention and the configurations depicted for the lens, aperture, and reflector are considered most acceptable.

The aforementioned, substantially rectangular light output distributions attainable by the invention are the result of utilization of the defined HID lamp having its internal elongated arc length therein in combination with a reflector 51 which in turn includes a plurality of internal reflecting surfaces of different configurations. Specifically, these reflecting surfaces are preferably of substantially parabolic, spherical, and cylindrical configuration. More particularly, those internal reflective surfaces running substantially parallel to the elongated arc length are a combination of both parabolic and spherical configurations while those surfaces at the opposing ends of the reflector (including the end having opening 95 therein) are comprised of a series of parallel, substantially cylindrical internal reflecting surfaces. These latter surfaces are best illustrated in one end of the reflector (facing the viewer) in FIG. 4 while the aforementioned parabolic and spherical surfaces are best illustrated in FIG. 2 (behind lamp 80). To assure a relatively smooth pattern, it is preferred to internally stipple lens 43.

Figure 6A:
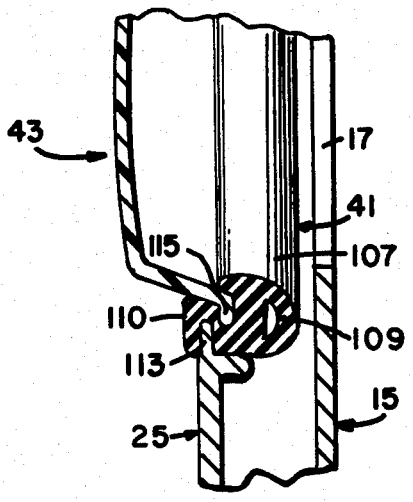
FIGS. 6A and 6B illustrate the cover member, lens, and compressible gasket of the luminaire of FIG. 1 in both a partly opened and a fully closed position.
Figure 6B:
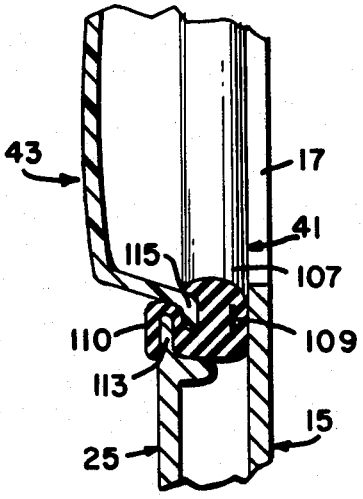

In FIGS. 6A and 6B, there is illustrated in greater detail the resulting compression of gasket 41 against planar mounting plate 15. Specifically, in FIG. 6A the cover member 25 having lens 43 and compressible gasket 41 located therein is shown as it is about to engage plate 15. In FIG. 6B, full closure is shown. As stated above, compression of gasket 41 exerts force against the overlapping end segment of lens 43 so as to more firmly retain this member within cover 25. Such compression also assures a better seal between the lens and cover in the area about the lens. Even further, this means of engagement between gasket and mounting plate also provides a seal about the aperture 17 to thereby assure prevention of the incursion of particles (e.g., dust) from within the housing, if any, which particles could adversely affect the luminaire's output through lens 43. To further enhance compression of gasket 41, the gasket includes a main body portion 107 which extends about the periphery of lens 43 and includes therein a slot 109. Slot 109 runs substantially throughout body portion 107. Although the slot is illustrated in FIG. 6A as not containing anything (e.g., liquid) therein, it is within the scope of the invention to provide such a material. In FIG. 6B, full compression of gasket 41 has occurred. It can thus be seen that the gasket and lens arrangement of the invention provides a first seal (about the mounting plate's aperture), further assists in providing a second seal (about the contained lens), and also assists in retaining the lens in position. This is due primarily to the illustrated configuration for gasket 41 wherein an extending portion 110 thereof is designed to overlap an upstanding flange portion 113 of cover 25. The remaining, main body portion 107 thereby engages the lip segment 115 of lens 43 to substantially enclose this portion of the lens.

As also shown in FIG. 5, another gasket 121 is employed about the outer periphery of front cover 25 and is designed for engaging the corresponding periphery of the boxlike housing 11. Accordingly, a seal is provided at these locations in addition to the aforementioned seals provided by gasket 41. Gasket 121 is preferably rubber, and is secured to front cover 25 by a suitable adhesive.

While there have been shown and described what are at present considered the preferred embodiments of the invention, it will be obvious to those skilled in the art that various changes and modifications may be made therein without departing from the scope of the invention as defined by the appended claims.

What is claimed is:

1. A luminaire comprising:

a housing of substantially boxlike configuration and defining an opening therein:

a substantially planar component mounting plate secured to said housing substantially across said opening and including an aperture therein defined by two pairs of opposed sides, the sides of a first of said pairs being of substantially straight configuration and the sides of a second of said pairs being of substantially curved configuration:

a reflector positioned on said component mounting plate adjacent said aperture;

a lamp extending within said reflector; and a cover member pivotally located on said housing for providing a cover for said opening upon closure thereof, said cover including a lens therein and a compressible gasket located substantially about said lens, said closure of said cover causing compression of said gasket against said mounting plate substantially about said aperture, said compression of said gasket providing a seal about said lens and also assisting in retaining said lens in position within said cover member.

2. The luminaire according to claim 1 further including at least two pivot arms, each of said pivot arms being secured at opposing ends thereof to said housing and said cover member, respectively, said pivot arms being located in a spaced apart relationship to provide said pivotal movement of said cover member.

3. The luminaire according to claim 1 wherein said compressible gasket includes a body portion located substantially about said lens, said body portion including a slot therein to facilitate said compression of said gasket.

4. The luminaire according to claim 1 wherein said reflector includes a reflecting wall having an opening therein and a socket for having said lamp positioned therein, said socket passing through said opening within said reflecting wall.

5. The luminaire according to claim 4 further including a bracket secured to said reflector on an external surface thereof adjacent said opening, said socket being positioned on said bracket.

6. The luminaire according to claim 1 wherein said light source is a high intensity discharge lamp having an elongated arc length.

7. The luminaire according to claim 6 wherein said high intensity discharge lamp is selected from the group consisting of high pressure sodium, metal halide and mercury lamps.

8. The luminaire according to claim 1 wherein said reflector includes a forward opening of substantially annular configuration.

9. The luminaire according to claim 8 wherein said reflector includes a substantially annular flange portion, said flange portion being positioned on said component mounting plate substantially about said aperture therein in a flush relationship.

10. The luminaire according to claim 9 wherein said reflector is secured to said mounting plate by a pair of retention screws, said screws being located within said mounting plate on opposite sides of said aperture therein.

11. The luminaire according to claim 9 wherein said reflector includes therein a plurality of reflecting surfaces of different configurations.

12. The luminaire according to claim 11 wherein said different configurations for said reflecting surfaces include parabolic, spherical and cylindrical.

* * * * *